US007082282B2

(12) United States Patent
Kaneko

(10) Patent No.: US 7,082,282 B2
(45) Date of Patent: Jul. 25, 2006

(54) IMAGE FORMATION METHOD AND IMAGE FORMATION APPARATUS FOR SAME

(75) Inventor: Chiemi Kaneko, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 68 days.

(21) Appl. No.: 11/017,970

(22) Filed: Dec. 22, 2004

(65) Prior Publication Data

US 2005/0169677 A1 Aug. 4, 2005

(30) Foreign Application Priority Data

Dec. 26, 2003 (JP) ..... 2003-432318
Oct. 15, 2004 (JP) ..... 2004-302310

(51) Int. Cl.
*G03G 15/20* (2006.01)

(52) U.S. Cl. ..... 399/309; 399/16; 399/306; 399/364

(58) Field of Classification Search ..... 399/16, 399/18, 21, 19, 306, 309, 364, 374
See application file for complete search history.

(56) References Cited

U.S. PATENT DOCUMENTS 5,963,770 A * 10/1999 Eakin ..... 399/364
6,608,988 B1 * 8/2003 Conrow ..... 399/364
6,786,149 B1 * 9/2004 Lomoine et al. ..... 101/223
6,801,742 B1 10/2004 Mochimaru et al.
2003/0235442 A1 12/2003 Suzuki et al.
2004/0101332 A1 5/2004 Sohmiya et al.
2004/0131398 A1 7/2004 Omata et al.
2005/0031384 A1 2/2005 Sohmiya et al.

FOREIGN PATENT DOCUMENTS

JP 11-38687 2/1999
JP 2000-352889 12/2000
JP 2002-189387 7/2002

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image formation method and image formation apparatus capable of forming images on both sides of a recording medium even if a first image formation unit or a second image formation unit does not have the required functions. Detection is conducted to determine whether or not the first image formation unit and second image formation unit have the required functions. If, as a result of this detection, it is determined that one of the image formation units does not have the required functions, the method of forming an image on both faces of the paper is switched to the method for forming an image using only the image formation unit having the required functions.

14 Claims, 8 Drawing Sheets

IMAGE FORMATION METHOD AND IMAGE FORMATION APPARATUS FOR SAME

BACKGROUND OF THE INVENTION

1. Field of the Invention

The present invention relates to an image formation method forming images on both faces of a recording medium, and an image formation apparatus.

2. Description of the Background Art

Conventional image formation apparatus for forming images on both faces of a recording medium having a first image formation part to form the image on one face of the recording medium, and a second image formation part to form the image on the other face of the recording medium, are disclosed in, for example, Japanese Patent Application Laid-open No. H11-38687 and Japanese Patent Application Laid-open No. 2000-352889. In other words, the primary image formation part is a first image formation unit comprising image formation process devices such as an image carrier and the like, and a first intermediate transfer belt wherein a toner image (hereafter referred to as a 'primary image') on the afore-mentioned image carrier is transferred. Similarly, the second image formation part is a second image formation unit comprising image formation process devices such as an image carrier and the like, and a second intermediate transfer belt wherein a toner image (hereafter referred to as a 'second image') on the afore-mentioned image carrier is transferred. The first intermediate transfer belt is provided at a position opposite the one face of the recording medium to constitute the first transfer position. On the other hand, the second intermediate transfer belt is provided at a position opposite the other face of the recording medium to constitute the second transfer position. By feeding the recording medium to the first transfer position and second transfer position, the first image is formed on one face of the recording medium, and the second image is formed on the other face of the recording medium. Images are thus formed on both faces of the recording medium.

However, in the case of such image formation apparatus, if a fault and the like occurs in either the first or second image formation unit, there is a problem that, if the prescribed operation is no longer possible, image formation on both faces is no longer possible.

Technologies relating to the present invention are (also) disclosed in, for example, Japanese Patent Application Laid-open No. 2002-189387.

SUMMARY OF THE INVENTION

With the foregoing in view, it is an object of the present invention to provide an image formation method, and an image formation apparatus for same, wherein images can be formed on both faces even if the first or second image formation unit no longer has the required functions.

In accordance with the present invention, provided is an image formation method for transferring a first image created with a first image formation unit to one face of a recording medium, and transferring a second image created with a second image formation unit to the other face of the recording medium, wherein, if it is detected that either the first image formation unit or the second image formation unit does not have required functions, the image formation method is selected such that the first image and the second image are formed with the one of the image formation units having the required functions, the first image is transferred to one face of the recording medium, and the second image is transferred to the other face of the recording medium.

Also provided is an apparatus for forming images comprising: a first image formation part comprising a first image formation unit forming a first image and a first intermediate transfer body on which the the first image is transferred; a second image formation part comprising a second image formation unit forming a second image and a second intermediate transfer body on which the second image is transferred; a first transfer device to transfer the first image to one side of a recording medium; a second transfer device to transfer the second image to the other side of the recording medium; a detection device to detect whether or not the first image formation unit and the second image formation unit have the required functions; and a switching device to switch, when the detecting device has detected that either one of the first and second image formation units does not have the required functions, from an image formation method of forming the first image with a first image formation unit, transferring the first image to the first intermediate transfer body and then to one face of the recording medium, forming the second image with a second image formation unit, and transferring the second image to the second intermediate transfer body and then to the other face of the recording medium in accordance with the detection device, to an image formation method of forming the first image and the second image with the image formation unit having the required functions, transferring the first image to the first intermediate transfer body and then to one face of the recording medium and transferring the second image to the second intermediate transfer body and then to the other face of the recording medium.

BRIEF DESCRIPTION OF THE DRAWINGS

The above, and other objects, features, and advantages of the present invention will become more apparent from the following detailed description taken with the accompanying drawings in which.

DESCRIPTION OF THE PREFERRED EMBODIMENTS

Description will be made of an embodiment wherein the image formation apparatus of the present invention is applied.

Figure 1:
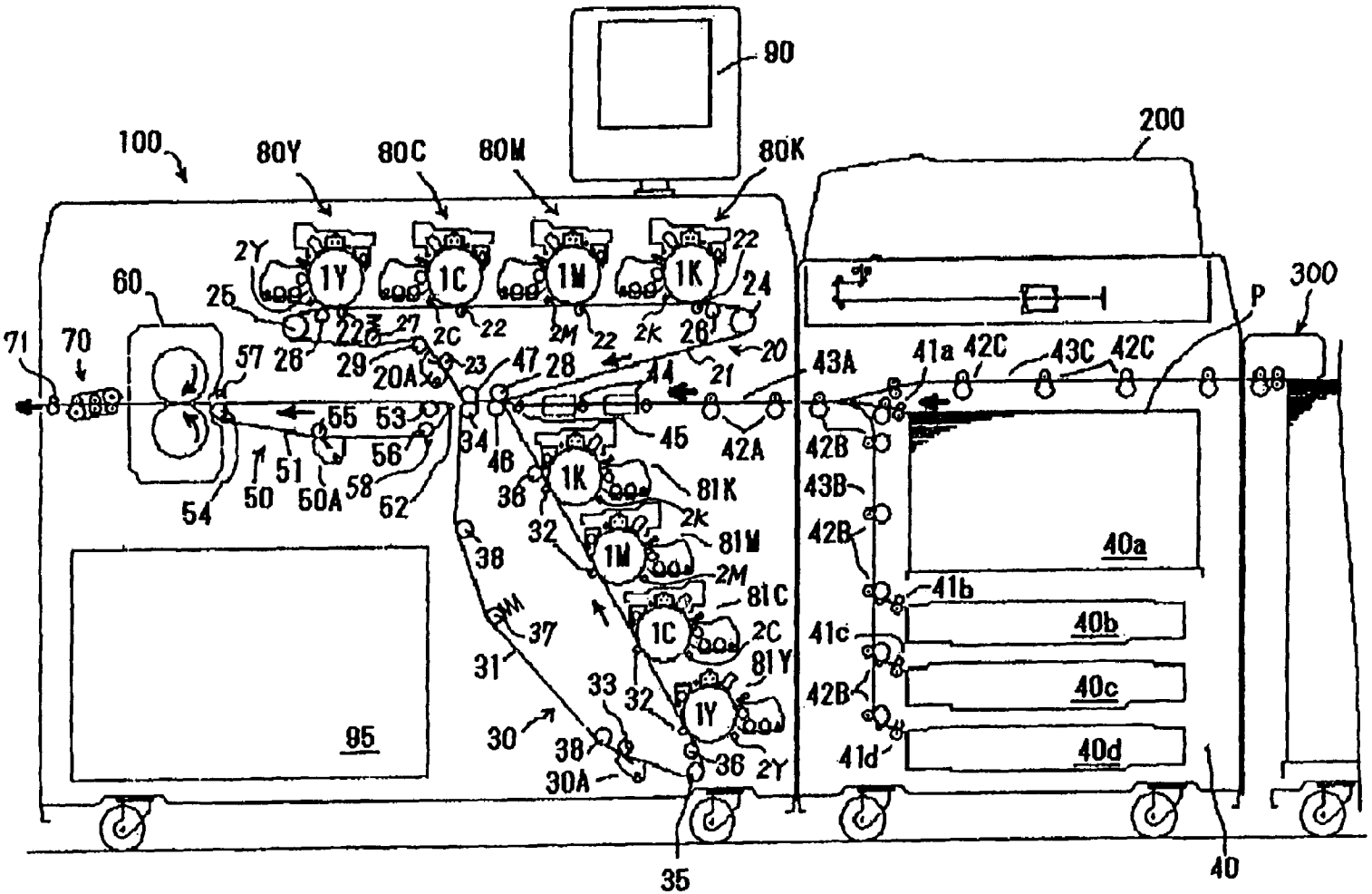
FIG. 1 is a view showing the configuration in outline of the image formation apparatus according to one embodiment of the present invention.

FIG. 1 shows the configuration of a full color printer capable of double-faced printing by electrophotography, with the image formation apparatus related to the present embodiment labeled as 100. As shown in the figure, the primary image formation part 20 is positioned above, and the second image formation part 30 is positioned below, the recording medium feed path 43A within the main body 100 of this image formation apparatus. The primary image formation part 20 is provided with a first intermediate transfer belt 21 moving endlessly in the direction of the arrow, and the second image formation part 30 is provided with a second intermediate transfer belt 31 moving endlessly in the direction of the arrow. Four first image formation units 80Y, 80C, 80M, and 80K are positioned on the upper tensioned face of the first intermediate transfer belt 21. On the other hand, four second image formation units 81Y, 81C, 81M, and 81K are positioned on the upper tensioned face of the second intermediate transfer belt 31. Y, C, M, and K associated with the numbers of these primary and second image formation units correspond to the colors of toner handled, Y corresponding to yellow, C to cyan, M to magenta, and K to black. The same Y, C, M, and K are applied to the photoreceptors 1 provided in the first and second image formation units and rotate together with the first intermediate transfer belt 21 and second intermediate transfer belt 31. The photoreceptors 1Y through 1K are positioned equidistantly within the image formation parts 20 and 30, and in contact with at least part of the upper tensioned face of the intermediate transfer belts 21 and 31 respectively during image formation.

An electrostatic charging apparatus, an exposure apparatus, a developing apparatus, and a cleaning apparatus are provided near each photoreceptor 1K, 1M, 1C, and 1Y as image formation process devices. The electrostatic charging apparatus uniformly charges the surface of the photoreceptor rotated clockwise in the figure by a drive device (not shown). The image read by the manuscript reader apparatus 200 onto the uniformly charged photoreceptor surface is formed as an electrostatic latent image by the exposure apparatus. This electrostatic latent image is developed into a toner image by the developing apparatus. A transfer bias is then applied to the primary transfer rollers 22 and 32 (described later), and the toner image on the photoreceptor is primary-transferred onto the first or second intermediate transfer belts. The cleaning apparatus removes toner remaining on the surface of the photoreceptor following the primary transfer process.

Furthermore, reflective photosensors (hereafter referred to as 'P sensors') 2K, 2M, 2C, and 2Y are provided near the photoreceptors 1K, 1M, 1C, and 1Y as a detection device to detect the density of the toner image formed on the photoreceptors 1. The P sensor 2 comprises a light emitting device consisting of a light emitting diode and the like as a light emitting part, and a photosensitive device consisting of a photosensor such as a phototransistor and the like as a light receiving part. The light radiated from this light emitting part illuminates the prescribed location on the photoreceptor 1, and the amount of light reflected is detected by the light receiving part. This detection result is output from the P sensor 2 as a DC voltage. Here, the afore-mentioned amount of reflected light varies with the amount of toner adhering at the prescribed position on the photoreceptor 1. In other words, the value of the voltage output from the P sensor 2 varies with the amount of toner adhering at the prescribed position on the photoreceptor 1. Thus, the amount of toner adhering at the prescribed position is known. In the copier of the present embodiment, the value of the voltage output from the P sensor 2 decreases as the amount of toner adhering increases.

The afore-mentioned output voltage value is controlled by a PWM controller. The CPU varies the magnitude of the control signal to this PWM controller (hereafter referred to as the 'PWM value'), and thus the DC voltage supplied to the P sensor 2 (hereafter referred to as the 'output voltage value') can be varied.

The optical density of the standard image formed on the photoreceptors 1K, 1M, 1C, and 1Y is detected with the P sensors 2K, 2M, 2C, and 2Y. Based on this detection result, the necessary amount of toner is supplied from the toner hopper 7*a* to the developer mixing part of the developing unit 3 to approach the prescribed density.

Image density detection executes process control operation to ensure the correct image density for each color when power is switched on, or with the prescribed number of copies. A density detection patch (hereafter referred to as a 'standard pattern') is formed on each photoreceptor 1K, 1M, 1C, and 1Y during this process control operation. The standard pattern formed on each photoreceptor 1K, 1M, 1C, and 1Y is employed as a standard pattern of continuous gradation by selecting electrostatic bias and developing bias in sequence. In other words, in the present embodiment, the line-format standard pattern wherein the amount of toner adhering varies in gradations is created in the direction of movement of the surface of the photoreceptor. This standard pattern is then detected with the P sensor. Based on this detection result, the necessary amount of toner is supplied from the toner hopper to the developing apparatus to approach the prescribed density. When toner has not been supplied to the developing apparatus, toner becomes insufficient, and the toner image on the photoreceptor becomes lighter. In this condition, it is determined that [the photoreceptor] does not have the required functions, and operating mode of the image formation device (described later) is switched.

Furthermore, the afore-mentioned sensor can also be used to detect deterioration of the surface of the photoreceptor. P sensors 2K, 2M, 2C, and 2Y detect these defects, using the reduction in the reflectance ratio of the surface of the photoreceptor 1 and the [consequent] reduction in the amount of light reflected from the photoreceptor drum 1 when the surface of the photoreceptor 1 is damaged or becomes coated with a film of foreign matter. Detection of deterioration of the surface of the photoreceptor is executed automatically when power is switched on. Firstly, an electrostatic voltage and developing bias voltage are applied with the photoreceptors 1K, 1M, 1C, and 1Y rotated in the same manner as with normal image formation, and a non-image area created on the surface of the photoreceptors 1. The light is radiated by the light emitting element of the P sensor 2 onto this area, and the amount of light emitted by the P sensor 2, in other words, the value of the current flowing in the light emitting element is PWM-controlled so that the non-image output voltage of the P sensor 2 (Vsg) resulting from detection of light reflected from photoreceptor 1 by the photosensor element is 4.0. This PWM value is expressed in 256 steps, and is normally set to between 70 and 75 when a new photoreceptor drum 1 is used. The upper limit of the PWM value is set to 120, and when the actual PWM value exceeds this value, in other words, when this value exceeds 120, the amount of light reflected by the P sensor 2 is insufficient and is determined to be an abnormal value. In other words, when the PWM value exceeds 120, the surface of the photoreceptor is determined to have deteriorated and to no longer have the required functions, and the operating mode is switched (described later).

Next, description will be made of the intermediate transfer belt.

As the primary intermediate transfer body, the first intermediate transfer belt 21 is supported by a plurality of rollers 23, 24, 25, 26 (two), 27, 28, and 29 running in the direction of the arrow, and provided in the bottom of the photoreceptors 1Y, 1C, 1M, and 1K in the first image formation units 80Y through 80K. This first intermediate transfer belt 21 is endless, and is tensioned and positioned so that it is in contact with part of each photoreceptor. Furthermore, the primary transfer rollers 22 are provided on the inner periphery of the first intermediate transfer belt 21 opposite the photoreceptors 1Y, 1C, 1M, and 1K. The cleaning apparatus 20A is provided at a position opposite the roller 23 on the outer periphery of the first intermediate transfer belt 21. This cleaning apparatus 20A wipes and removes excess toner and paper dust and the like remaining on the surface of the first intermediate transfer belt 21. The first intermediate transfer belt 21, the first image formation units 80Y, 80C, 80M, and 80K, and the cleaning apparatus 20A are integrated to comprise the first image formation unit 20 being removable from the image formation apparatus 100.

On the other hand, the second intermediate transfer belt 31 corresponding to a second intermediate transfer body is supported by a plurality of rollers 33, 34, 35, 36 (two), and 38 running in the direction of the arrow. Furthermore, the second intermediate transfer belt 31 is tensioned by the tension roller 37, and provided in contact with the photoreceptors 1Y, 1C, 1M, and 1K in the second image formation units 81Y through 81K. This second intermediate transfer belt 31 is endless, and is tensioned and positioned so that it is in contact with part of each photoreceptor after the developing process. The primary transfer rollers 32 are provided on the inner periphery of the second intermediate transfer belt 31 opposite the photoreceptors 1Y, 1C, 1M, and 1K.

The cleaning apparatus 30A is provided at a position opposite the roller 33 on the outer periphery of the second intermediate transfer belt 31. This cleaning apparatus 30A wipes and removes excess toner and paper dust and the like remaining on the surface of the intermediate transfer belt 31.

The second intermediate transfer belt 31, the second image formation units 81Y, 81C, 81M, and 81K, and the cleaning apparatus 30A are integrated to comprise the second image unit 30 being removable from the image formation apparatus 100.

Figure 2:
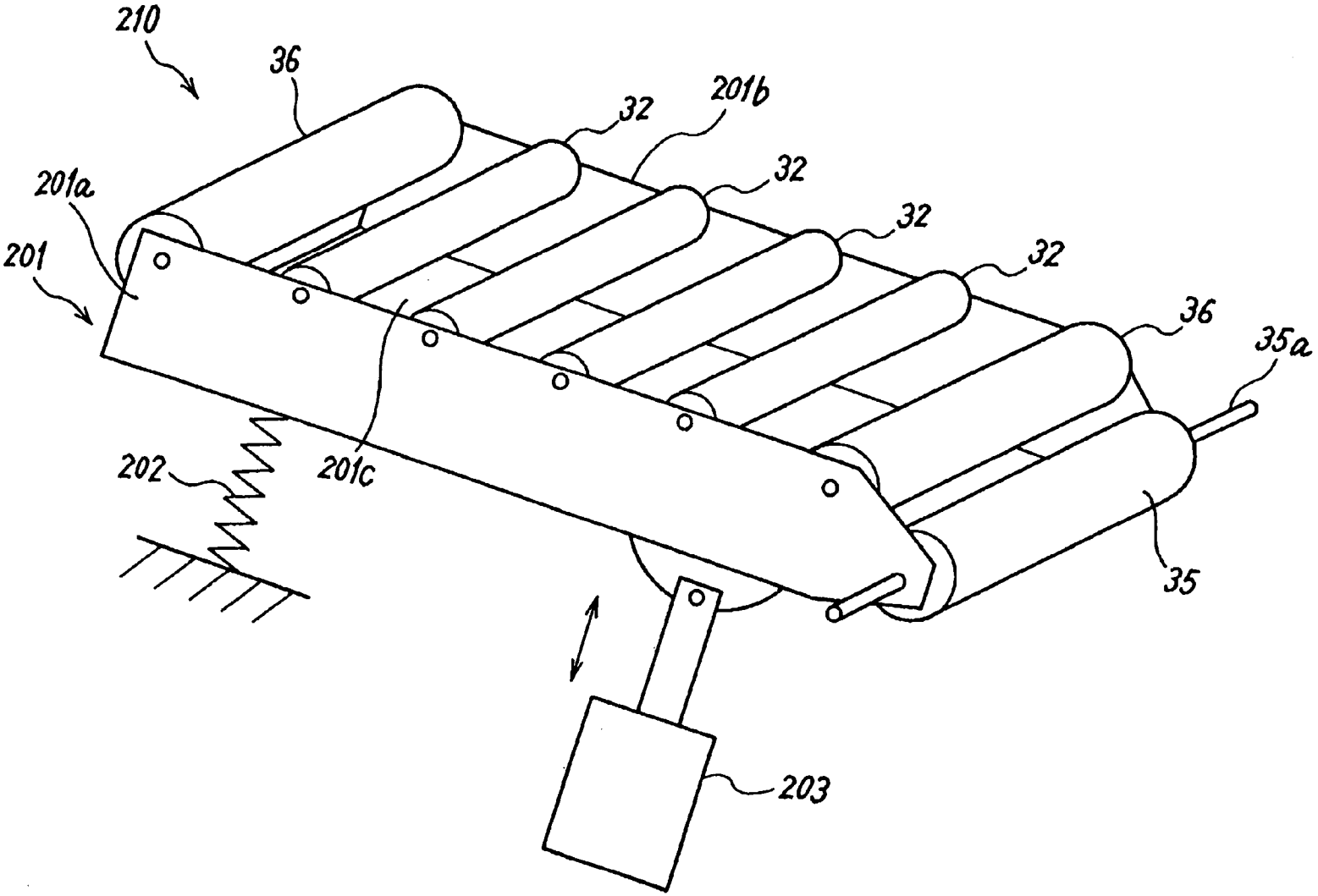
FIG. 2 is a perspective view showing the configuration in outline of the separation mechanism of the image formation apparatus.
Figure 3A:
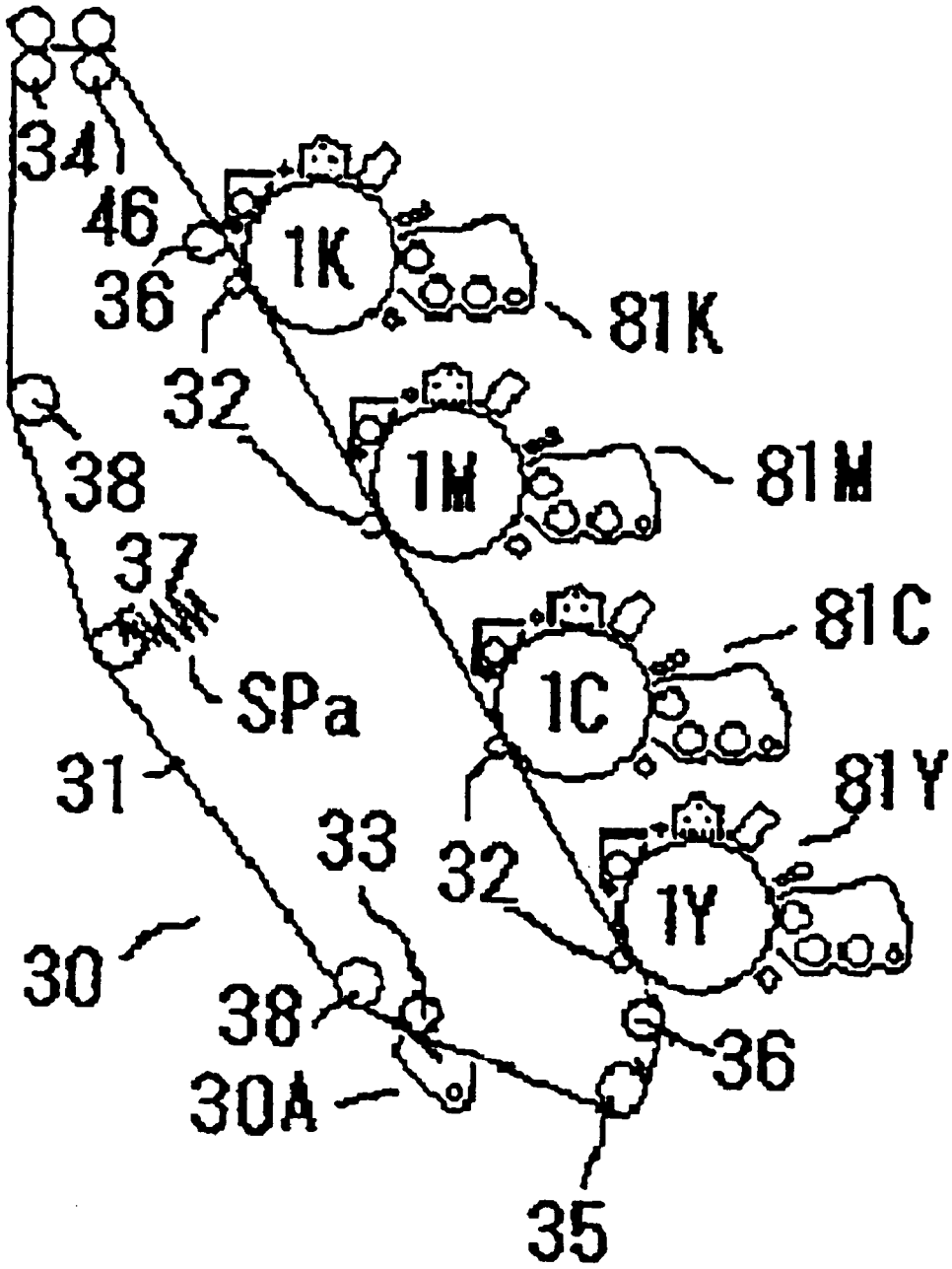
FIG. 3A is a view showing the configuration in outline of the second image formation part while the separation mechanism is not in operation.
Figure 3B:
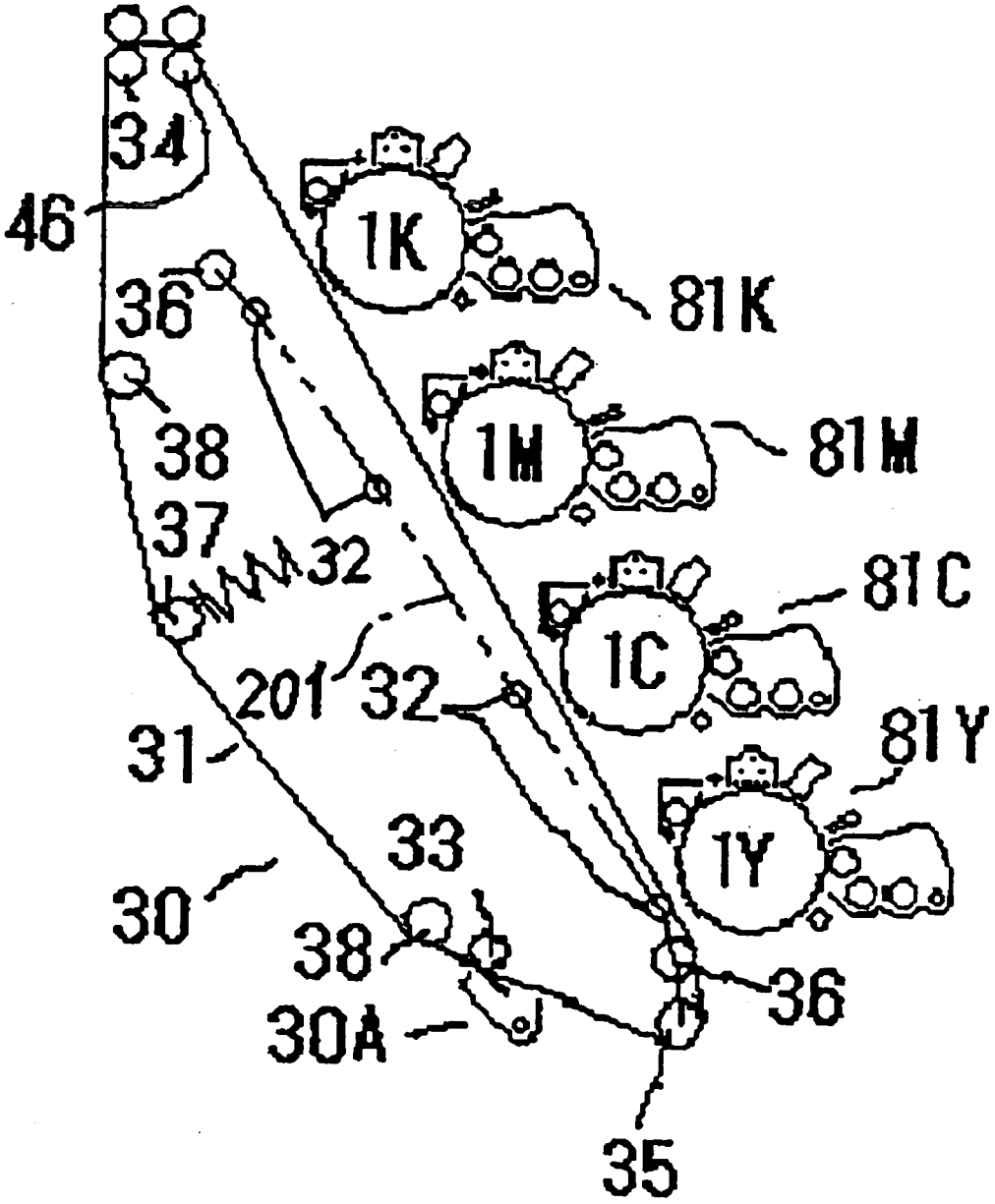
FIG. 3B is a view showing the configuration in outline of the second image formation part while the separation mechanism is in operation.

Furthermore, the separation mechanism 210 is provided as a separation device to separate the intermediate transfer belts from the photoreceptors. Description will be made of the separation mechanism separating the second intermediate transfer belt 31 from the photoreceptors 1Y through 1K. FIG. 2 is a perspective view showing the separation mechanism 210, FIG. 3A is a view showing the second image formation part while the separation mechanism is not in operation, and FIG. 3B is a view showing the second image formation part while the separation mechanism is in operation. The separation mechanism 210 shown in FIG. 2 has a roller retaining member 201 provided with a base plate 201*c*. Four primary transfer rollers 32, rollers 36 (two), and roller 35 are retained between side plates 201*a* and 201*b* of the roller retaining member 201. The plunger 203 is fitted to the base plate 201*c* of the roller retaining member 201. Furthermore, the spring 202 is fitted to the roller retaining member 201, forcing the roller retaining member 201 towards the photoreceptor. The roller 35 shaft 35*a* is passed through the roller retaining member 201 side plates 201*a* and 201*b*, and the roller 35 shaft 35*a* passed through the side plates is fitted to the side plates (not shown) of the image forming apparatus. Thus, the roller retaining member 201 may rotate on the center of the roller 35.

When at least one of the second image formation units 81Y, 81M, 81C, and 81K loses the function of being able to satisfactorily form an image due to deterioration of the photoreceptor or insufficient toner and the like, the plunger 203 draws the roller retaining member 201 in the downwards direction in the figure. The roller retaining member 201 then rotates on the center of the roller 35, and as shown in FIG. 3B, the roller 36 and the four primary transfer rollers 32 separate from the second intermediate transfer belt 31. The second intermediate transfer belt pressed against the photoreceptor by the roller 36 and four primary transfer rollers 32 attempts to bend, however it is re-tensioned by the tension roller 37. As a result, as shown in FIG. 3B, the second intermediate transfer belt 31 separates from the photoreceptor.

On the other hand, when a deteriorated photoreceptor is replaced and the like, and the second image formation unit has recovered the required functions, the drawing [action] of the plunger 203 is cleared. The roller retaining member 201 moves towards the photoreceptor around the center of the roller 35 by the force of the spring 202, and as shown in FIG. 3A, the four primary transfer rollers 32 contact the photoreceptors via the second intermediate transfer belt 31.

Description has been made above of the second image formation part, however the primary image formation part is of the same configuration. In other words, a roller retaining member retaining the roller 25, four primary transfer rollers 22, and two rollers 26, is provided. A spring and plunger are fitted to this roller retaining member, the spring forcing the roller retaining member towards the photoreceptor. Furthermore, the roller retaining member can rotate around the center of the roller 25. The roller retaining member rotates around the center of the roller 25 due to the drawing [action] of the plunger, and is separated from the photoreceptor. Separation of the roller retaining member from the photoreceptor also separates the four primary transfer rollers 22 contacting the photoreceptors via the first intermediate transfer belt from the photoreceptors. The first intermediate transfer belt 21 attempts to bend due to this separation, however it is tensioned again by the tension roller 27. As a result, the first intermediate transfer belt 21 separates from the photoreceptors. On the other hand, when the drawing [action] of the plunger is cleared, the roller retaining member moves towards the photoreceptor due to the spring force, and the four primary transfer rollers 22 each contact a photoreceptor via the first intermediate transfer belt 21. Thus the photoreceptors and the intermediate transfer belt are again brought into contact.

The separation mechanism is not limited to the above. For example, an eccentric cam 302 may be provided as a separation mechanism in each image formation unit 80Y through 80K and 81Y through 81K. The image formation unit is moved with this eccentric cam 302, separating, the photoreceptor and intermediate transfer belt. An example wherein the eccentric cam 302 is provided in the image formation unit 81K will be described below, however other image formation units have the same configuration. FIGS.

Figure 4A:
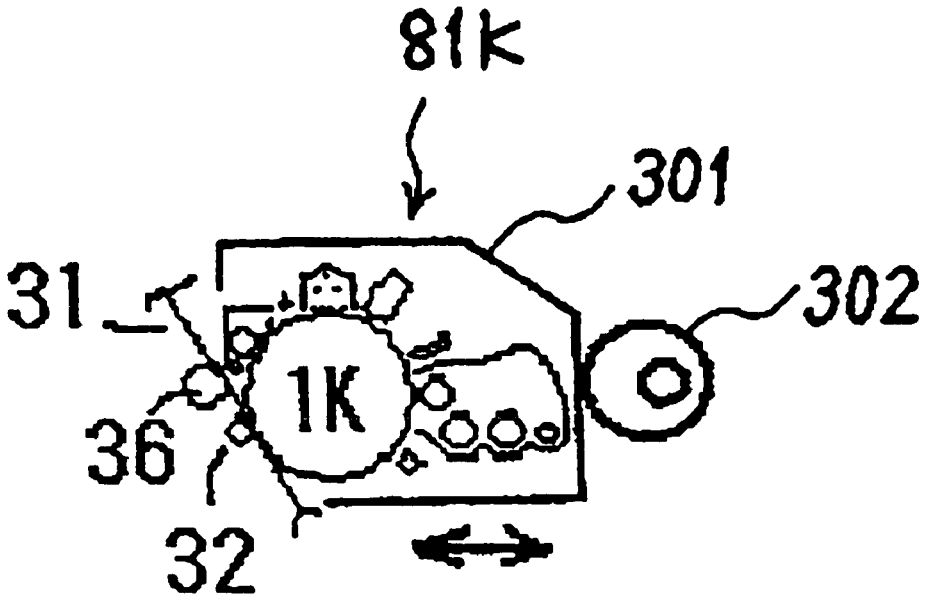
FIG. 4A is a view showing the photoreceptor and second intermediate transfer belt in contact in the image formation unit provided with another separation mechanism.
Figure 4B:
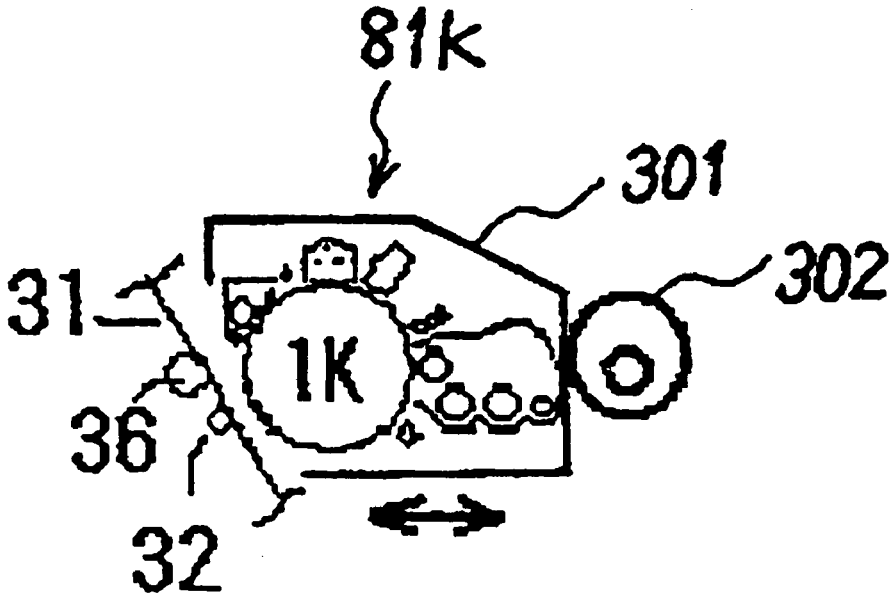
FIG. 4B is a view showing the photoreceptor and second intermediate transfer belt 31 separated in the image formation unit provided with another separation mechanism.

4A and 4B are views showing a configuration wherein the eccentric cam is provided in the image formation unit 81K. FIG. 4A is a view showing the photoreceptor 1K and the second intermediate transfer belt 31 in contact, and FIG. 4B is a view showing the photoreceptor 1K and the second intermediate transfer belt 31 separated. The image formation unit 81K is enclosed within the frame 301 together with the photoreceptor and image formation process devices (electrostatic charging apparatus, exposure apparatus, developing apparatus, and cleaning apparatus). Furthermore, the image formation unit 81K is forced in the direction of separation from the second intermediate transfer belt 31 by a forcing device (not shown). The frame 301 of the image formation unit 81K contacts the eccentric cam 302. When the image formation unit 81K loses the function of being able to satisfactorily for an image due to deterioration of the photoreceptor or insufficient toner and the like, the eccentric cam 302 constituting the separation mechanism rotates. The image formation unit 81K is then separated from the second intermediate transfer belt 31, assuming the condition shown in FIG. 4B. When a deteriorated photoreceptor is replaced and the like, and the second image formation unit 81K has recovered the required functions, the eccentric cam 302 is rotated and the image formation unit and the second intermediate transfer belt 31 are brought into contact.

Furthermore, as shown in FIG. 1, the first intermediate transfer belt 21 and the second intermediate transfer belt 31 are endless and move in the forward direction while in mutual contact to constitute the secondary transfer nip.

Furthermore, the first intermediate transfer belt 21 is tensioned within the afore-mentioned secondary transfer nip, and the first secondary transfer roller 46 is provided at a position opposite the grounded support roller 28. This first secondary transfer roller 46 is provided on the inner periphery of the second intermediate transfer belt 31, and contacts the inner peripheral surface of the second intermediate transfer belt. A transfer bias opposite to that of the toner is applied to the secondary transfer roller 46 from the power supply (not shown), and a 50 μA transfer current flows. By [introducing] the transfer current in the first secondary transfer roller 46 while passing the paper P between the first intermediate transfer belt 21 and the secondary transfer roller 46, the image is transferred to the paper P with the toner carried by the first carrier belt 21.

The second intermediate transfer belt 31 is tensioned within the afore-mentioned secondary transfer nip, and the second secondary transfer roller 47 is provided at a position opposite the grounded support roller 34. This second secondary transfer roller 47 is provided on the inner periphery of the first intermediate transfer belt 21, and contacts the inner peripheral surface of the first intermediate transfer belt 21. A transfer bias of polarity opposite to that of the toner is applied to the secondary transfer roller 47 from the power supply (not shown) introducing a 50 μA transfer current. By introducing the transfer current while passing the paper P between the second intermediate transfer belt 31 and the secondary transfer roller 47, the image is transferred to the paper P with the toner image carried by the second intermediate transfer belt 31.

In the present embodiment, the image is transferred to the paper by introducing the transfer current in the secondary transfer rollers 46 and 47, however the image may also be transferred to the paper by applying a transfer voltage to the secondary transfer rollers 46 and 47. Furthermore, a transfer bias of a polarity opposite to that of the toner is applied to the secondary transfer rollers 46 and 47 in secondary transfer in the present embodiment, however, a method wherein a transfer bias of the same polarity as that of the toner is applied may also be used. In this case, only the grounded support roller and the secondary transfer roller need be changed. In practice, the secondary transfer rollers wherein a transfer bias of the same polarity as that of the toner is applied are the support rollers 28 and 34, and the secondary transfer rollers 46 and 47 are grounded, to transfer the image on the intermediate transfer belt to the paper.

The paper supply apparatus 40 enclosing paper for supply is positioned at the right of the image formation apparatus 100. A plurality of stages, for example, a paper supply apparatus (tray) 40*a* enclosing a large amount of paper in the upper stage, and three stages of paper cassettes 40*b*, 40*c*, and 40*d* below able to be perpendicularly removed to the front (towards the operating panel), are provided. Different types of paper P are enclosed in the paper tray 40*a* and paper cassettes 40*b*, 40*c*, and 40*d*. Of these, the paper in the topmost position is selectively supplied and separated by the corresponding paper supply and separation devices 41*a* through 41*d* and fed to the recording medium feed path 43B and 43A one sheet at a time by a plurality of pairs of feed rollers 42B.

A pair of register rollers 45 are provided in the recording medium feed path 43A to obtain supply timing for feeding the paper P to the secondary transfer position being the first and second transfer positions. Furthermore, a horizontal registration compensation mechanism 44 is provided in the recording medium feed path 43A to correct the position in the direction relative to the feed direction of the paper to the normal P sensor.

The paper P is fed from the pair of registration rollers 45 towards the transfer area being the first transfer position and comprising the first intermediate transfer belt 21 and the secondary transfer roller 46. The [paper] is then fed towards the transfer area being the second transfer position and comprising the second intermediate transfer belt 31 and the second secondary transfer roller 47.

The paper may be supplied to the recording medium feed path 43C having the pair of feed rollers 42C from a separate paper supply apparatus 300 able to be provided upstream in the feed direction. A paper supply tray 40*a* top paper supply surface is provided to ensure that paper in the topmost paper supply tray 40*a* is supplied, and then fed almost horizontally and directly without bending. Thick paper and rigid card can therefore be reliably supplied.

A recording medium transport device 50 is provided to feed paper having passed through the second transfer position on the extension of the recording medium feed path 43A up to the fixing nip in the fixing apparatus 60 provided downstream in the recording medium feed direction while maintaining it in a flat condition. The recording medium transport device 50 has rollers 52, 53, 54, 55 and 56 supporting the endless feed belt 51 transporting [the paper] in the direction of the arrow. A cleaning apparatus 50A is provided opposite the roller 55, a suction charger 58 to grip the recording medium P is provided opposite the roller 56, and a destaticizer and separation charger 57 are provided opposite the roller 54, on the outside of the feed belt 51.

A fixing apparatus 60 having a heating device is provided downstream in the paper feed direction of the recording medium transport device 50. A type wherein a heater is provided within a roller, a belt fixing apparatus running a heated belt, or a fixing apparatus wherein induction heating is employed as the heating method, and the like can be employed. Material, hardness, and surface nature of the fixing rollers and fixing belts is made the same top and bottom to ensure the same hue and glossiness of the images on both faces of the paper. Furthermore, fixing conditions are controlled for full color and monochrome images, and for single or double-faced [operation], and control [conducted] with a control device (not shown) to ensure that fixing conditions are optimized in response to paper type. A pair of cooling rollers 70 having a cooling function are provided in the feed path after fixing to cool paper for which fixing is complete, and to stabilize unstable toner as soon as possible. Rollers of a heatpipe construction having a heater can be employed as this pair of cooling rollers 70. The cooled paper is discharged from the image formation apparatus 100 by the pair of discharge rollers 71.

A keyboard is provided with the operation and display unit 90 provided on the top of the image formation apparatus 100 to enable entry of conditions for image formation and the like. Furthermore, the condition and the like of the apparatus is displayed on the display to facilitate exchange of information between the operator and image formation apparatus 100. Furthermore, the power supplies and control boards in the electrical and control apparatus 95 provided within the image formation apparatus 100 are protected by, and enclosed within, a sheet metal frame.

Figure 5:
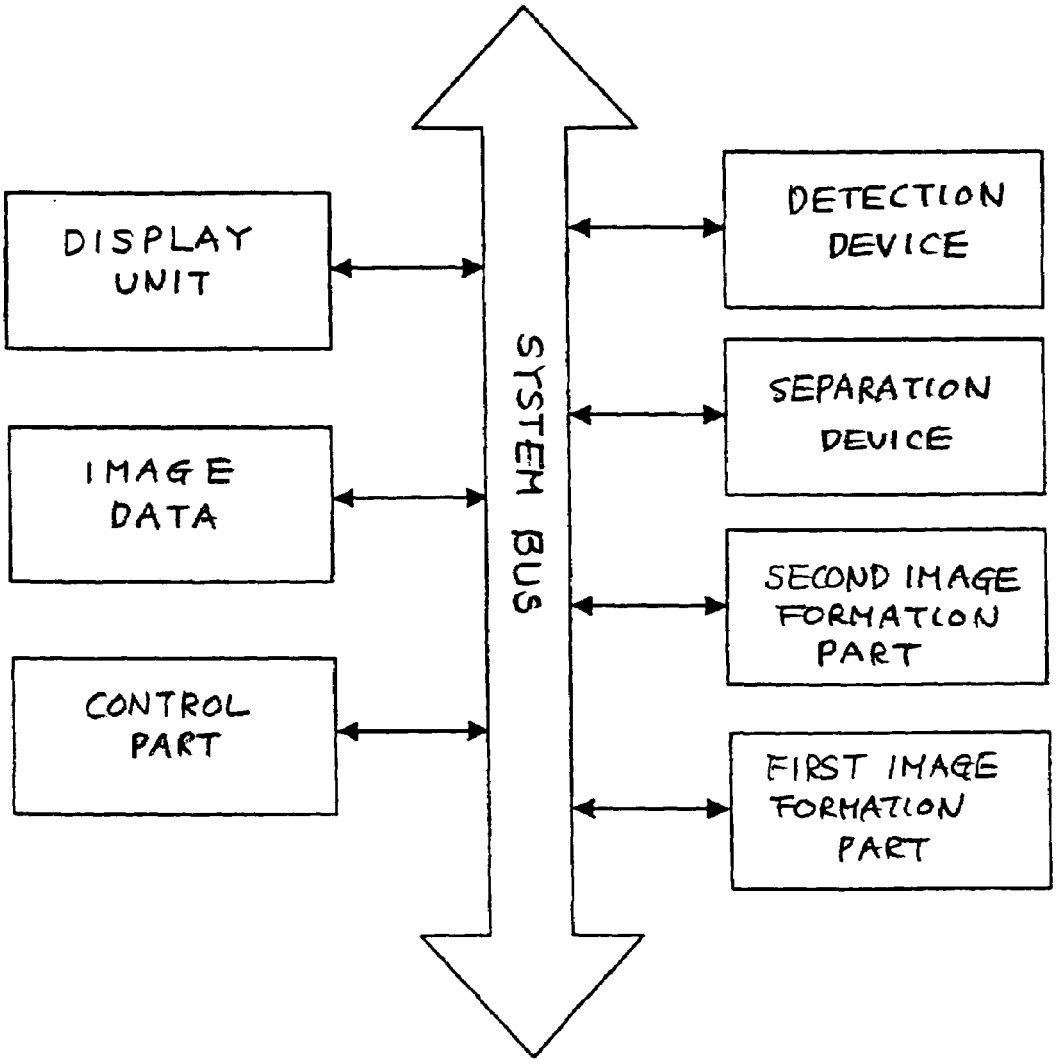
FIG. 5 is a block diagram showing the configuration of the control system of the image formation apparatus.

FIG. 5 shows the configuration of the control system of the image formation apparatus. As shown in the figure, the control system comprises a system bus, a control part, a detection device, a separation device, image data, a display unit, a second image formation part, and a first image formation part. The detection device comprises a P sensor to detect the state of deterioration and density and the like of the surface of the photoreceptor, a T sensor to detect the density of the toner within the developing apparatus, and a torque sensor to detect the rotational torque of the photoreceptor and the like. The image data is image data read by the automatic image reader apparatus (ADF) 200. Furthermore, the separation device comprises a separation mechanism. The control part comprises a CPU, RAM, and ROM and the like.

The afore-mentioned control part controls image formation of the first image formation part and the second image formation part. Furthermore, when the control part detects that the first image formation units or the second image formation units have lost the function to satisfactorily form an image due to deterioration of the photoreceptor or insufficient toner and the like, the [control part] may also be used as a device to switch from the normal operating mode wherein double-faced image formation is conducted with both the first image formation units and the second image formation units to the temporary operating mode wherein double-faced image formation is conducted with only the unit having the function to satisfactorily form an image. Furthermore, the afore-mentioned control part may also be used as an operation control part to operate the separation mechanism.

Single-faced recording operation wherein a full color image is formed on one face of the paper P in the image formation apparatus 100 will be described below.

The single-faced recording method is basically of two types, either of which may be selected. One of the two types is a method whereby the image carried by the first intermediate transfer belt 21 is transferred directly to one face of the paper, and the other is a method whereby the image carried by the second intermediate transfer belt 31 is transferred directly to one face of the paper. The method whereby the image is carried by the first intermediate transfer belt 21 and transferred to the paper will be described below.

When the image formation apparatus 100 is operated, the first intermediate transfer belt 21, and the photoreceptors 1Y, 1C, 1M, and 1K in the first image formation units 80Y through 80K, rotate. The second intermediate transfer belt 31 rotates simultaneously, however, the photoreceptors 1Y, 1C, 1M, and 1K in the second image formation units 81Y through 81K are separated from the second intermediate transfer belt 31 and do not rotate. Firstly, operation begins with image formation with the image formation unit 80Y, and a Y color toner image is formed on the photoreceptor 1Y. This Y color toner image formed on the photoreceptor is primary-transferred electrostatically on the first intermediate transfer belt 21 moving synchronously with the photoreceptor 1Y by the transfer action of the primary transfer rollers 22. In the same manner, primary transfer operation is also conducted in sequence with the appropriate timing for the photoreceptors 1C, 1M, and 1K. Thus, a full color toner image wherein the yellow, cyan, magenta, and black toner images are overlapped in sequence is carried on the primary intermediate transfer belt 21. This full color toner image is moved with the primary intermediate transfer belt 21 in the direction of the arrow image in the figure.

Simultaneously, the paper P used for recording is fed from the paper supply tray 40*a* or a paper cassette 40*b* through 40*d* in the paper supply apparatus 40 by one of the paper supply and separation devices 41*a* through 41*d*. [The paper] is then fed to the recording medium feed path 43C by the pair of feed rollers 42B and 42C. Prior to the leading edge of the paper being gripped by the pair of registration rollers 45, the horizontal registration compensation mechanism 44 is slid so that it is pressed against the reference guide horizontal in relation to the paper feed direction in order to align the paper in the horizontal direction. The paper is temporarily halted by the pair of registration rollers 45 and again fed to the transfer area with the appropriate timing to ensure that it is in the correct position in relation to the image on the primary intermediate transfer belt 21.

The full color toner image on the primary intermediate transfer belt 21 is transferred by the transfer action of the first secondary transfer roller 46 to the top surface of the paper P fed synchronously with the primary intermediate transfer belt 21. The bias provided to the first secondary transfer roller 46 is positive (opposite of toner charging polarity). Following transfer, the surface of the primary intermediate transfer belt 21 is cleaned with the belt cleaning apparatus 20A. Furthermore, foreign matter such as toner and the like remaining on the surface of the photoreceptors 1Y, 1C, 1M, and 1K in the first image formation units 80Y through 80K for which primary transfer is complete is removed with the cleaning apparatus 2.

The paper P whereon the full color toner image on the primary intermediate transfer belt 21 has been transferred is transported towards the fixing apparatus 60 by the recording medium transport device 50 feed belt 51. The surface of the feed belt 51 is charged by the paper suction charger 58 beforehand to ensure that the paper P can be reliably fed on the feed belt 51. The destaticizer and separation charger 57 [then] operates to ensure that the paper P is separated from the feed belt 51 and fed reliably to the fixing apparatus 60.

The full color toner image on the paper P is fixed by the heat of the fixing apparatus 60 and melted, and colors mixed, to form a complete full color image. Since toner is present only on one face (the top surface) of the paper, the heat energy required for fixing is low compared to that for double-faced recording with toner on both surfaces. The control device (not shown) controls the electric power used by the fixing apparatus to the optimum in response to the image. Until the fixed toner becomes fully hardened on the paper it is rubbed by the feed path guide members and the like, and image drop-out and disturbance occurs. To prevent this problem, a pair of cooling rollers 70 being a cooling device operates to cool the toner and paper. [The paper] is then discharged with the discharge rollers 71.

The image method wherein the image carried by the second intermediate transfer belt 31 is transferred directly to one face of the paper is basically the same as the single-faced recording process, and a description is therefore omitted.

Operation during double-faced recording wherein an image is formed on both faces of the paper P will be described below.

When the start signal is input to the image formation apparatus, an image in each color is formed in sequence on the first image formation units 80Y, 80C, 80M, and 80K, and primary-transferred in sequence to the primary intermediate transfer belt 21. Almost in parallel with the process of carrying [this image] as the first image, a process is conducted whereby the images of each color formed in sequence on the second image formation units 81Y, 81C, 81M, and 81K are primary-transferred in sequence to the second intermediate transfer belt 31 and carried as second images. Furthermore, since [the paper] is halted and fed again by the pair of registration rollers 45, paper is supplied in consideration of this time period, and aligned with the horizontal registration compensation mechanism 44. The pair of registration rollers 45 feed the paper to the first transfer position comprising the first secondary transfer roller 46 and the first intermediate transfer belt 21 with the appropriate timing. A positive transfer current flows in the first secondary transfer roller 46, and the image is transferred from the first intermediate transfer belt to one face of the paper P (the top face in the figure).

The paper P having an image on one face in this manner is then fed to the second secondary transfer roller 47 at the second transfer position. By applying a positive transfer current to the second secondary transfer roller 47, the full color second image already carried on the second intermediate transfer belt 31 is transferred to the bottom face of the paper P in one action.

The paper P whereon full color toner images have been transferred to both faces in this manner is fed to the fixing apparatus 60 by the feed belt 51. The surface of the feed belt 51 is charged with a negative charge (same polarity as toner) by the suction charger 58. Care is taken to ensure that toner on the bottom face of the paper which is not yet fixed is not transferred to the belt. An alternating current is applied to the destaticizer and separation charger 57, and the paper is separated from the belt 51 and transported to the fixing apparatus 60. The toner images on both faces of the paper are fixed by the heat of the fixing apparatus 60 and melted and colors mixed. The paper is then passed through the pair of cooling rollers and discharged by the discharge rollers 71.

When the separation mechanism shown in FIGS. 4A and 4B is used, monochrome recording with only black toner is possible. In such cases, some photoreceptors are used. The unused photoreceptors 1Y, 1C, and 1M, and the developing apparatus 5, are therefore not only not operated, but the intermediate transfer belts 21 and 31 are maintained such that they not in contact with these unused photoreceptors. In this case, by rotating the eccentric cams 302 for all except the K color, the photoreceptors 1M, 1C, and 1Y can be separated from the intermediate transfer belts 21 and 31. Furthermore, the separation mechanism shown in FIG. 2, FIG. 3A, and FIG. 3B is positioned on the center of rotation of the roller retaining member, however if this center of rotation is the roller 36 near the photoreceptor 1K, it is possible to contact only the K color photoreceptor 1K with the intermediate transfer belts as in the separation mechanism shown in FIG. 4A and FIG. 4B. In this case, the pulling force of the plunger is reduced in comparison with the pulling force when all the photoreceptors 1K, 1Y, 1C, and 1M are separated from the intermediate transfer belts, and the angle of rotation of the roller retaining member is smaller than the angle of rotation when the photoreceptors 1K, 1Y, 1C, and 1M separate. Since the distance of movement due to rotation is reduced the closer a roller is to the center of rotation, and the primary transfer roller 32 contacting the K color photoreceptor 1K near the roller 36 being the center of rotation via the intermediate transfer belts is more difficult to separate from the photoreceptor than are other primary transfer rollers. Therefore, if the angle of rotation of the roller retaining member is adjusted with the pulling force of the plunger, it is possible to have only the primary transfer roller opposite the K color photoreceptor in contact via the intermediate transfer belts. Creation of a monochrome image with black toner can therefore be executed with only the photoreceptor 1K in contact with the intermediate transfer belts 21 and 31, providing advantages in terms of extending the life of the other photoreceptors 1M, 1C, and 1Y.

The image formation apparatus of the present embodiment can form an image on both faces of the transfer paper P even if the first image formation units 80 or second image formation units 81 do not have the required functions due to a fault and the like. Image formation operation forming images on both faces of the paper P when the second image formation units 81 no longer have the required functions will be described below.

[Loss of] the afore-mentioned required functions refers to a condition wherein a satisfactory image cannot be formed. In practice, a condition wherein insufficient toner results in a light image, a condition wherein an image cannot be formed due to lack of toner, or a condition of difficulty in forming an image on a photoreceptor due to deterioration of the photoreceptor.

Firstly, deterioration and density of the photoreceptor is detected with the P sensor 2 as the detection device of the apparatus main body when the printer main body is switched on. If the PWM value with detection of deterioration exceeds 120, a condition wherein the surface of the photoreceptor has deteriorated and formation of an image on the photoreceptor is difficult, or a condition wherein a satisfactory image cannot be formed due to reduced toner density and the like as a result of insufficient toner, is detected and the control part informs the user of this information on the display unit 90. Furthermore, if for example, a toner density sensor is fitted to the toner container in the developing apparatus, the presence or absence of toner in the container can be detected, and if toner is not supplied, the user is informed on the display unit 90 that [the developing apparatus] does not have the function for formation of a satisfactory image. Furthermore, a reference pattern may be formed on the second intermediate transfer belt 31, and [this pattern] read by a sensor to detect whether or not [the belt] has the function for formation of a satisfactory image.

The display unit 90 displays whether the second image formation units 81 can satisfactorily form an image, and an instruction screen for selecting the temporary operating mode for double-faced image formation with only the first image formation units 80 is displayed. The user operates the select button and the like in accordance with the instructions on the display unit 90 to switch from the normal mode wherein images are formed on both faces of the paper using both the first image formation units 80 and the second image formation units 81, to the temporary operating mode wherein images are formed on both faces of the paper using only the first image formation units 80. Furthermore, as a separate method, when a condition wherein the second image formation units 81 do not have the required functions due to a fault and the like is detected with the aforementioned detection device of the apparatus main body, the control part automatically selects the temporary operating mode wherein only the first image formation units are used for formation of images on both faces of the paper. The user is then informed by the display unit 90 that the temporary operating mode wherein only the first image formation units are used for formation of images on both faces of the paper has been selected. Furthermore, the user evaluates from the printed image whether the second image formation units 81 have the required functions. The temporary operating mode wherein only the first image formation units 80 are used for formation of images on both faces of the paper may then be selected.

Next, the temporary operating mode wherein only the first image formation units 80 are used for formation of images on both faces of the paper will be practically described.

When the start signal is input to the image formation apparatus, a mirror image of the image transferred from the second intermediate transfer belt 31 to the paper P (second image) is created on the first image formation units 80K through 80Y, and a full color image formed on the first intermediate transfer belt 21. At this time, the control part operates the separation mechanism 210 and the photoreceptors 1Y, 1C, 1M, and 1K in the second image formation units 81Y through 81K and the second intermediate transfer belt 31 are separated and do not rotate. Furthermore, the second intermediate transfer belt 31 and first intermediate transfer belt 21 are rotated at the same speed. The second image on the first intermediate transfer belt 21 is moved in the direction of the arrow together with the first intermediate transfer belt 21, and fed to the first image transfer position positioned in the secondary transfer nip.

The second image on the first intermediate transfer belt 21 is transferred to the second intermediate transfer belt 31 rotating at the same speed as the first intermediate transfer belt 21 by the transfer action of the first secondary transfer roller 46. A 30 μA current flows in the first secondary transfer roller 46 from the power supply (not shown). Furthermore, the bias provided to the first secondary transfer roller 46 is of opposite polarity (positive) to the charging polarity of the toner. In the present embodiment, while a 50 μA transfer current flows when the toner image is transferred to the paper P, transfer control differs in that a 30 μA transfer current flows when the second image is transferred to the second intermediate transfer belt 31. Since the low transfer current applied when the toner image is transferred to the second intermediate transfer belt 31 reduces the resistance value between the support roller and the secondary transfer roller to the extent that there is no paper P between [the second intermediate transfer belt 31] and the roller 28, it is possible to transfer [the image] with a low current. If, for example, the transfer current is set to the same [value] as the current flowing when transferring the toner image to the paper P (50 μA), an undesirable situation may occur wherein current may become excessive and a current leak occur. Therefore, the transfer current flowing when the second image is transferred from the first intermediate transfer belt 21 to the second intermediate transfer belt 31 is set to 30 μA, being different from the [current] flowing from the intermediate transfer belts to the paper P, and thus the occurrence of leaks can be suppressed.

The first intermediate transfer belt 21 transferring the second image to the second intermediate transfer belt 31 is cleaned with the cleaning apparatus 20A. The image (first image) transferred to the paper from the first intermediate transfer belt 21 by the first image formation units 80K through 80Y is created and carried by the first intermediate transfer belt. The first image carried on the first intermediate transfer belt 21 is fed to the secondary transfer nip. On the other hand, the second image on the second intermediate transfer belt 31 is rotated once, and the leading edge of the second image fed to the secondary transfer nip so that it is synchronized with the leading edge of the first image carried on the first intermediate transfer belt 21. The second intermediate transfer belt 31 and the second image formation units 81 are separated by the separation mechanism 210 at this time to prevent the toner image on the second intermediate transfer belt 31 rubbing against the second image formation units 81 and being disturbed.

Simultaneously, the paper P is fed to the secondary transfer nip by the pair of registration rollers 45. The first image on the first intermediate transfer belt 21 at the first transfer position is transferred to one face of the paper P fed to the secondary transfer nip. The transfer current at this time is 50 μA. The paper P having an image on one face is then fed to the second transfer roller 47 at the second transfer position. The second image on the second intermediate transfer belt 31 is transferred to the other face of the paper P. The first intermediate transfer belt 21 and the second intermediate transfer belt 31 rotate at the same speed, and the leading edge of the image on the first intermediate transfer belt 21 and the leading edge of the image on the second intermediate transfer belt 31 are fed simultaneously to the secondary transfer nip. Thus, the image can be transferred to the front and rear of the paper without slippage.

Furthermore, the second image being a mirror image created with the first image formation units 80 is transferred to the paper as the normal image, and the correct image is recorded on the paper. The second image is transferred from the first image formation units 80, transferred from the first intermediate transfer belt 21 to the second intermediate transfer belt 31, and then transferred to the paper. Thus, the second image is a tertiary transferred image transferred three times. When a normal image is created with the image formation unit in this manner as the first image transferred from the first image formation units 80 to the first intermediate transfer belt 21, and then transferred to the paper, a mirror image is therefore transferred to the paper. Thus, by creating the image with the image formation unit as the second image transferred three times as a mirror image, the image transferred to the paper is the normal image.

In this manner, the paper P whereon the full color image is transferred to both faces is transported to the fixing apparatus 60 by the feed belt 51. The [image] is fixed by the heat of the fixing apparatus 60, and the toner image on both faces of the paper melted and mixed. The paper is then passed through the cooling rollers discharged with the discharge rollers 71.

In the temporary operating mode wherein only the first image formation units 80 are used for formation of images on both faces of the paper, the second image is transferred three times up to transfer to the paper P, however the first image is only transferred twice. Since the number of transfers differs for the first image and second image, the amount of toner adhering to the paper P is less for the second image than for the first image. The density of the image may therefore differ between the two faces of the paper P in some cases. Density is therefore controlled so that it differs when the first image and second images are created with the first image formation units. In practice, by increasing toner density of the second image in comparison to the first image, the toner density of the first image and second image transferred to the paper P is approximately the same. Images of approximately the same density can be obtained on both faces of the paper P.

Furthermore, in the case of a full color image, since the image wherein the toner of the four colors is overlapped is transferred, the Y color toner being the first transferred from the photoreceptor to the intermediate transfer belts also readily remains after transfer, and the toner image readily becomes light. It is therefore desirable that the density of the Y color toner image be greater than the density of the toner images for other colors.

The temporary operating mode wherein only the second image formation units 81 are used for transfer to both faces of the paper is basically the same as the temporary operating mode in the case wherein images are formed on both faces of the paper using only the afore-mentioned first image formation units 80. The condition of loss of the function to satisfactorily form an image due to deterioration of the photoreceptor or insufficient toner and the like in the first image formation units 80 is detected by a detection device such as the P sensor and the like fitted to the first image formation units 80Y through 80K. When the detection device detects the condition of loss of the function to satisfactorily form an image in at least one of the first image formation units 80Y through 80K as described above, the control part notifies the user and manually or automatically switches from the normal operating mode wherein images are formed on both faces of the paper using both the first image formation units 80 and the second image formation units 81, to the temporary operating mode wherein images are formed on both faces of the paper using only the second image formation units 81.

The temporary operating mode wherein images are formed on both faces of the paper using only the second image formation units 81 firstly creates the first image initially transferred to the paper P from the first intermediate transfer belt 21, and transfers it to the second intermediate transfer belt 31. As a mirror image, the first image created with the second image formation units 81 has greater toner density in comparison to the second image. Next, the first image on the second intermediate transfer belt 31 is transferred to the first intermediate transfer belt. The second image is then created on the second image formation units 81 and carried by the second intermediate transfer belt 31. The leading edge of the first image on the first intermediate transfer belt 21, and the leading edge of the second image on the second intermediate transfer belt 31, are simultaneously fed to the secondary transfer nip and transferred to both faces of the paper at the respective transfer positions. The paper P on which images are formed on both faces is then fixed with the fixing apparatus 60 and discharged by the discharge rollers 71.

The normal operating mode wherein images are formed on both faces of the paper using both the first image formation units 80 and the second image formation units 81 is switched to the temporary operating mode wherein images are formed on both faces of the paper using only the image formation unit having the required functions when the power supply of the printer itself is switched on, or after the prescribed number of copies have been taken, however, [timing] is not limited to this. For example, it is also possible to switch [modes] during image forming operation of the image formation apparatus.

Figure 6:
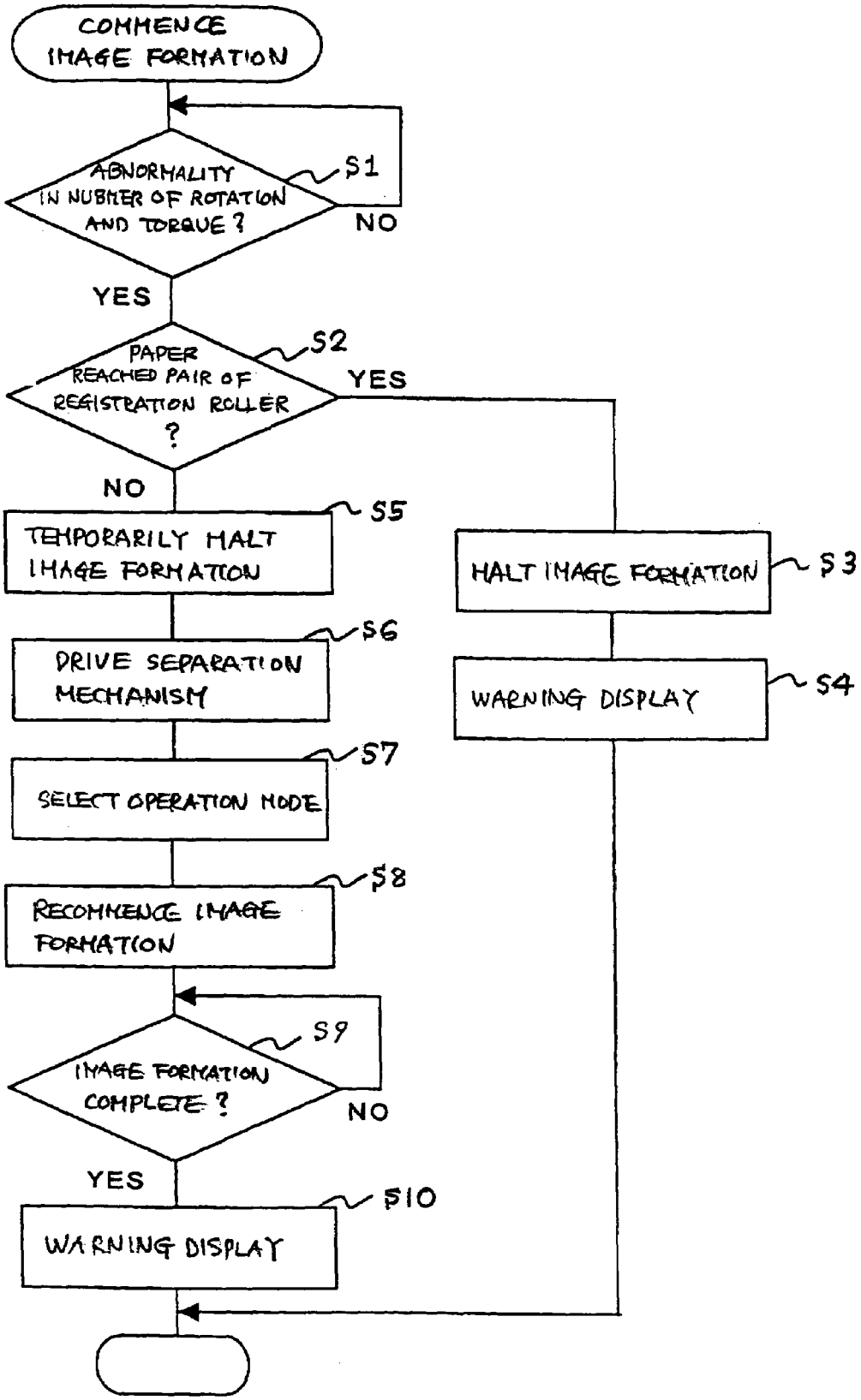
FIG. 6 is a flow chart showing control of selection of operating mode during image formation operation of the image formation apparatus.

Next, control of selection during image formation operation will be described in reference to FIG. 6.

Firstly, the detection device detects the number of rotations and torque of the photoreceptor and the developing roller, and checks for any abnormality in the number of rotations and torque (S1). If an abnormality is found, a check is made to determine whether or not the paper has already been fed as far as the pair of registration rollers 45 (S2). If the paper has reached the pair of registration rollers 45 (S2 YES), since preparations for operation of the image formation unit have commenced, image formation operation is halted (S3), a warning notifying occurrence of an abnormality is displayed on the display unit 90 (S4), and operation completed. On the other hand, if the paper has not yet reached the pair of registration rollers 45 (S2 NO), image formation operation is halted temporarily (S5), the separation mechanism 210 is driven, and the image formation unit on the side wherein the abnormality occurred is separated from the intermediate transfer belt (S6). When the image formation unit on the side wherein the abnormality occurred is separated from the intermediate transfer belt, the control part switches to the temporary operating mode wherein images are formed on the paper using only the image formation unit having the required functions (S7). Image formation operation is then resumed (S8), and image formation in the temporary operating mode wherein images are formed on the paper using only the image formation unit having the required functions is executed (S8). When the formation of the prescribed number of images is complete, (S9 YES), a warning notifying occurrence of an abnormality is displayed on the display unit 90 (S10) and operation is completed.

In this manner, the image formation mode may be switched during image formation operation, and halting of the apparatus due to an error and the like during image formation operation can be suppressed. As a result, following restoration [of normal operation], the trouble involved in forming the same image again and the like can be reduced.

Since only the K color image formation unit is used in the monochrome mode, even if the Y, M, and C color image formation units do not have the required functions, double-faced copying using the K color first image formation unit 80K and the K color second image formation unit 81K is possible. Therefore, even if the Y, M, and C color image formation units do not have the required functions, in the monochrome mode, double-faced copying using the first image formation units and the second image formation units may be made possible.

Next, control during double-faced image formation operation will be described in reference to FIG. 7.

Figure 7:
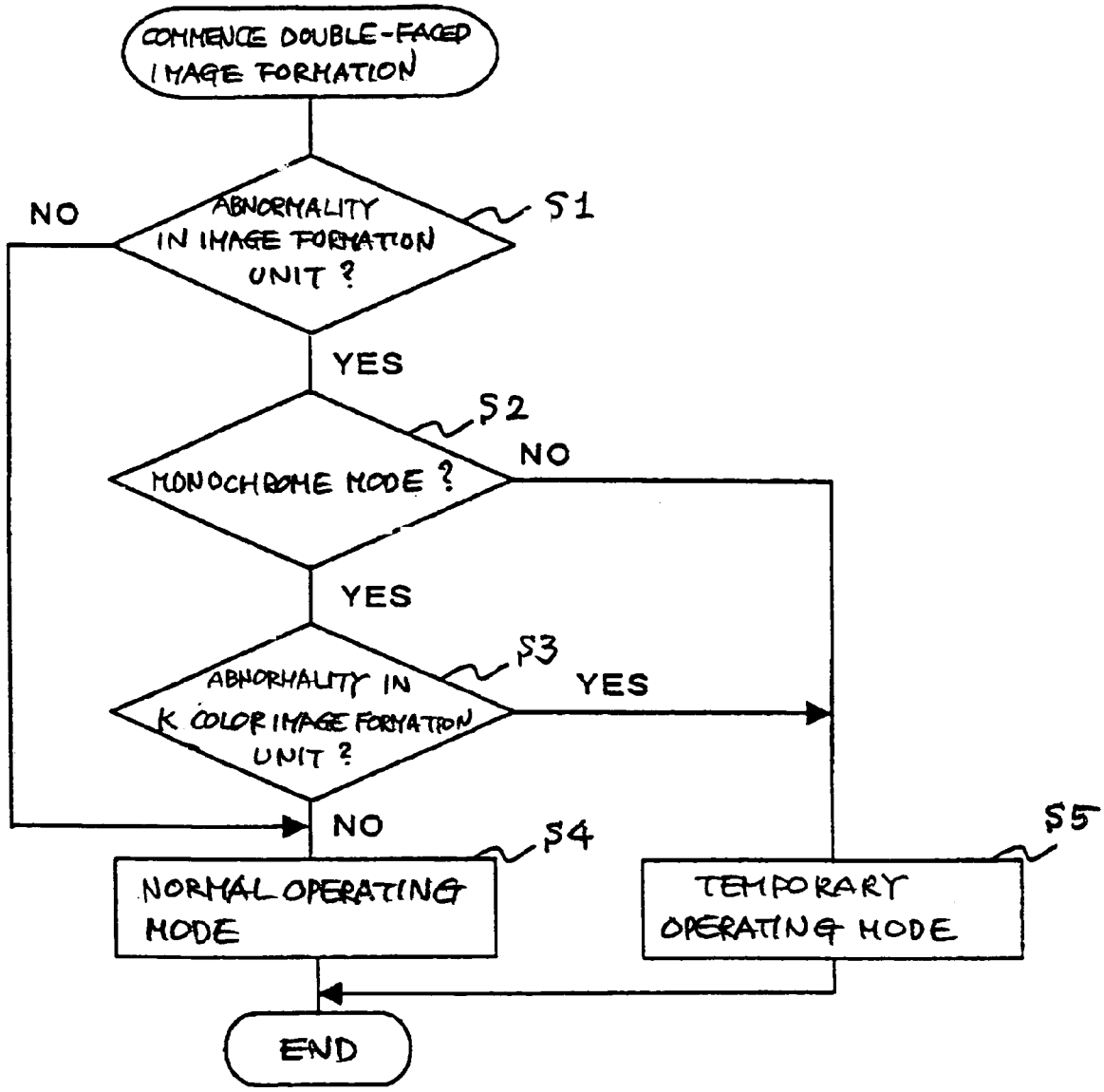
FIG. 7 is a flow chart showing control during double-faced image formation operation of the image formation apparatus.

As shown in FIG. 7, when double-faced image formation operation is commenced, a check is made to determine whether or not there is an error in the image formation unit (S1). If no error is found in any of the image formation units (S1 NO), the first image formation units and the second image formation units are used in executing the normal operating mode for double-faced image formation (S4). On the other hand, if an error occurs in an image formation unit (S1 NO), a check [is made] to determine whether or not the monochrome mode is selected (S2). In the monochrome mode (S2 YES), a check is made to determine whether or not there is an error in the K color image formation unit (S3). If no error is found in either the K color first image formation unit or the K color second image formation unit (S3 NO), double-faced image formation is conducted in the normal operating mode (S4). On the other hand, in other than the monochrome mode (S2 NO), and when an error occurs in one of the K color image formation units (S3 YES), the temporary operating mode wherein double-faced image formation is conducted with an image formation unit having the required functions is executed (S5).

According to the present embodiment, when the first image formation units 80K through 80Y and the second image formation units 81K through 81Y have the required functions, the image is created on one face of the paper with the first image formation units. Furthermore, the image is created on the other face of the paper with the second image formation units. The image created with the first image formation units is transferred from the first intermediate transfer belt 21 to one face of the paper, and the image created with the second image formation units is transferred from the second intermediate transfer belt 31 to the other face of the paper. Thus, the image can be created at high-speed on both faces of the paper. On the other hand, if either the first image formation units 80K through 80Y and the second image formation units 81K through 81Y does not have the required functions due to a fault and the like, the image is formed on both faces of the paper using only the image formation unit having the required functions. The image is created on one face of the paper with the image formation unit having the required functions, and this image is transferred from one intermediate transfer belt to the other intermediate transfer belt. Next, the image on the other face of the paper is formed with the image formation unit having the required functions, and transferred to the intermediate transfer belt. Thus, the image is transferred from one intermediate transfer belt to one face of the paper, and the image is transferred from the other intermediate transfer belt to the other face of the paper. In this manner, the image can be formed on both faces of the paper even if one image formation unit does not have the required functions due to a fault and the like.

Furthermore, in the present embodiment, a check is made to determine whether or not the first image formation units 80K through 80Y and the second image formation units 81K through 81Y have the required functions. If, as a result of the check, it is evaluated that one of the image formation units does not have the required functions, the image formation method is switched to the method of forming the image on both faces of the paper using only the image formation unit having the required functions. Thus, the image can be formed on both faces of the paper even if one image formation unit does not have the required functions due to a fault and the like.

Furthermore, in the present embodiment, a separation device mutually separating the image formation unit which does not have the required functions from the intermediate transfer body is provided as a separation mechanism. Thus, the problem of the image formation unit which does not have the required functions rubbing the toner image on the intermediate transfer belt and disturbing the image can be prevented.

Furthermore, the first secondary transfer roller 46 is provided on the inner periphery of the second intermediate transfer belt 31, and the second secondary transfer roller 47 is provided on the inner periphery of the first intermediate transfer belt 21. Thus, the secondary transfer rollers 46 and 47 are not contaminated by toner scattered during transfer to the paper and intermediate transfer belts. Occurrence of an abnormal image due to transfer defects can therefore be suppressed.

Furthermore, transfer bias is applied with the secondary transfer rollers 46 and 47 in contact with the intermediate transfer belts 21 and 31. Thus, electrical discharge does not occur suppressing the generation of ozone, and an environmentally-friendly image formation apparatus can be obtained.

Furthermore, since bias is applied to the secondary transfer rollers 46 and 47 and transfer conducted, the image can be reliably transferred.

Furthermore, in the present embodiment, part of the first intermediate transfer belt 21 and part of the second intermediate transfer belt 31 are positioned opposite each other to constitute the secondary transfer nip. Thus, the image can be transferred from one intermediate transfer belt to the other intermediate transfer belt within this secondary transfer nip. Furthermore, the paper is fed to this secondary transfer nip and the image on the first intermediate transfer belt 21 is transferred to one face of the paper, and the image on the second intermediate transfer belt 31 is transferred to the other face of the paper. Thus, an image can be formed on both faces of the paper without [the need for] switch-back of the paper. Image formation time is therefore shorter than with double-faced image formation using switch-back.

Furthermore, since a mirror image of the manuscript image is created with the image formation unit for the tertiary transfer image transferred from the image formation unit to the intermediate transfer belt, transferred from this intermediate transfer belt to the other intermediate transfer belt, and then transferred to the paper, the image transferred to the paper is not reversed.

Furthermore, in the present embodiment, the transfer current flowing when the image is transferred from one intermediate transfer belt to the other intermediate transfer belt is controlled so that it is less than the transfer current flowing when the image is transferred from the intermediate transfer belt to the paper. Thus, the occurrence of leaks and the like is suppressed, and a satisfactory image can be formed.

Furthermore, the image formation unit is controlled so that toner density when the tertiary transfer image transferred between the first intermediate transfer belt 21 and the second intermediate transfer belt 31 and then to the paper is formed with the image formation unit is greater than when the secondary transfer image transferred to the paper without transfer between the intermediate transfer belts is formed. Thus, the density of the image on both faces of the paper can be made the same.

Furthermore, the leading edge of the image on the first intermediate transfer belt 21 and the leading edge of the image on the second intermediate transfer belt 31 are fed simultaneously to the secondary transfer nip. Thus, the image can be transferred to the front and rear of the paper without slippage.

In the present embodiment, even if it is detected that either the first image formation units or the second image formation units do not have the required functions, if the first image formation unit 80K used when forming a specific image (monochrome image), and the second image formation unit 81K used when forming a specific image (monochrome image) have the required functions, both the first image formation unit 80K and the second image formation unit 81K are used to form the image on both faces of the paper in the normal operating mode. Thus, even if at least one image formation unit does not have the required functions, if the image formation units 80K and 81K used in forming the specific image (monochrome image) have the required functions [the image] can be formed in the normal operating mode. Thus, the specific image (monochrome image) can be processed without reducing the image formation speed.

Furthermore, the afore-mentioned specific image is not limited to a monochrome image, and for example, images in other basic colors (Y, M, C), and images in two colors such as K and M, may be [formed].

As described above, according to the present embodiment, if it is detected that the first image formation units or the second image formation units do not have the required functions due to a fault and the like, the first image and second image are formed with the image formation unit having the required functions, and the method of forming images on both faces of the recording medium is selected. Thus, even if the prescribed operation is not possible due to a fault and the like in the first image formation units or the second image formation units, this has the effect of allowing formation of the image on both faces of the recording medium.

Various modifications will become possible for those skilled in the art after receiving the teaching of the present disclosure without departing from the scope thereof.

What is claimed is:

1. An image formation method for transferring a first image created with a first image formation unit to one face of a recording medium, and transferring a second image created with a second image formation unit to the other face of said recording medium, wherein, if it is detected that either said first image formation unit or said second image formation unit does not have required functions, the image formation method is selected such that said first image and said second image are formed with the one of said image formation units having the required functions, said first image is transferred to one face of said recording medium, and said second image is transferred to the other face of said recording medium.

2. An apparatus for forming images comprising:

a first image formation part comprising a first image formation unit forming a first image and a first intermediate transfer body on which the said first image is transferred;

a second image formation part comprising a second image formation unit forming a second image and a second intermediate transfer body on which said second image is transferred;

a first transfer device to transfer said first image to one side of a recording medium;

a second transfer device to transfer the second image to the other side of said recording medium;

a detection device to detect whether or not said first image formation unit and said second image formation unit have the required functions; and a switching device to switch, when said detecting device has detected that either one of the first and second image formation units does not have the required functions, from an image formation method of forming said first image with a first image formation unit, transferring said first image to said first intermediate transfer body and then to one face of said recording medium, forming said second image with a second image formation unit, and transferring said second image to said second intermediate transfer body and then to the other face of said recording medium in accordance with said detection device, to an image formation method of forming said first image and said second image with the image formation unit having the required functions, transferring said first image to said first intermediate transfer body and then to one face of said recording medium and transferring said second image to said second intermediate transfer body and then to the other face of said recording medium.

3. An apparatus for forming images as claimed in claim 2, further comprising:

a separation device to relatively separate the image formation unit not having the required functions from the intermediate transfer body.

4. An apparatus for forming images as claimed in claim 2, wherein said first transfer device and said second transfer device are provided on the inner periphery of said first or second intermediate transfer body.

5. An apparatus for forming images as claimed in claim 4, wherein said first transfer device and said second transfer device are in contact with the inner peripheral surface of said first or second intermediate transfer body.

6. An apparatus for forming images as claimed in claim 2, wherein a transfer bias is applied to said first transfer device and said second transfer device.

7. An apparatus for forming images as claimed in claim 2, wherein:

said first intermediate transfer body and said second intermediate transfer body constitute a nip; and an image on said first intermediate transfer body is transferred to one face of the recording medium, while an image on said second intermediate transfer body is transferred to the other face of the recording medium, in the course of feeding a recording medium inserted in said nip to the downstream side further than the nip in the direction of endless movement of the surfaces of the intermediate transfer bodies.

8. An apparatus for forming images as claimed in claim 7, wherein:

the leading edge of the image on said first intermediate transfer body and the leading edge of the image on said second intermediate transfer body are simultaneously fed to said nip and transferred to both sides of the recording medium.

9. An apparatus for forming images as claimed in claim 2, wherein:

a first image or second image formed with the image formation unit having the required functions is a tertiary transfer image which is transferred from said image formation unit to the intermediate transfer body, transferred from said intermediate transfer body to a another intermediate transfer body, and then transferred to a recording medium, and image control conducted when said tertiary transfer image formed with said image formation unit differs from image control conducted when another image is formed.

10. An apparatus for forming images as claimed in claim 9, wherein:

said image control forms the image being said tertiary transfer image as a mirror image.

11. An apparatus for forming images as claimed in claim 9, wherein:

said image control is toner density control.

12. An apparatus for forming images as claimed in claim 9, wherein:

control conducted when the image is transferred between one intermediate transfer body and another intermediate transfer body differs from control conducted when the image is transferred between said intermediate transfer body and the recording medium.

13. An apparatus for forming images as claimed in claim 2, wherein:

a plurality of said image formation units is provided, said plurality of image formation units being arranged opposite an intermediate transfer body;

toner images of various colors are created with the plurality of image formation units, respectively; and said toner images are overlapped on said intermediate transfer body to form a color image.

14. An apparatus for forming images as claimed in claim 13, wherein:

a plurality of said first image formation units is provided, said plurality of first image formation units being arranged opposite said first intermediate transfer body;

a plurality of said second image formation units is provided, said plurality of second image formation units being arranged opposite said second intermediate transfer body; and even if said detection device detects that either any of the first image formation units or any of second image formation units do not have the required functions, provided that a first image formation unit of said plurality of first image formation units used in forming a specific image, and a second image formation unit of said plurality of second image formation units used in forming a specific image, have the required functions, said first image is formed with this first image formation unit, transferred to said first intermediate transfer body, and subsequently transferred to one face of a recording medium, and the second image is formed with this second image formation unit, transferred to said second intermediate transfer body, and subsequently transferred to the other face of said recording medium.

* * * * *